US007784927B2

(12) United States Patent
Inoue et al.

(10) Patent No.: US 7,784,927 B2
(45) Date of Patent: Aug. 31, 2010

(54) INK CONTAINER AND INK JET RECORDING APPARATUS

(75) Inventors: Ryoji Inoue, Kawasaki (JP); Ryoichi Matsumoto, Tokyo (JP); Hideki Ogura, Yokohama (JP); Shogo Kawamura, Numazu (JP); Satoshi Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 11/812,538

(22) Filed: Jun. 20, 2007

(65) Prior Publication Data

US 2008/0055376 A1 Mar. 6, 2008

Related U.S. Application Data

(63) Continuation of application No. PCT/JP2005/024169, filed on Dec. 22, 2005.

(30) Foreign Application Priority Data

Dec. 22, 2004 (JP) ..... 2004-371058

(51) Int. Cl.
*B41J 2/175* (2006.01)

(52) U.S. Cl. ..... 347/86

(58) Field of Classification Search ..... 347/85, 347/86

See application file for complete search history.

(56) References Cited

U.S. PATENT DOCUMENTS

| | | | | |
|---|---|---|---|---|
| 6,168,267 | B1 | 1/2001 | Komplin | 347/86 |
| 6,203,146 | B1 | 3/2001 | Pawlowksi, Jr. | 347/85 |
| 6,830,324 | B2 | 12/2004 | Ogura et al. | 347/86 |
| 6,877,848 | B2 * | 4/2005 | Shimizu et al. | 347/86 |
| 6,969,161 | B2 | 11/2005 | Kuwabara et al. | 347/85 |
| 7,290,861 | B2 | 11/2007 | Inoue et al. | 347/49 |
| 7,311,388 | B2 | 12/2007 | Ogura et al. | 347/87 |
| 2002/0109760 | A1 * | 8/2002 | Miyazawa et al. | 347/86 |

FOREIGN PATENT DOCUMENTS

| | | |
|---|---|---|
| JP | 63-13749 | 1/1988 |
| JP | 63-22653 | 1/1988 |
| JP | 5-229133 | 9/1993 |
| JP | 5-254139 | 10/1993 |
| JP | 5-270001 | 10/1993 |
| JP | 6-106732 | 4/1994 |
| JP | 7-241998 | 9/1995 |
| JP | 2000-85138 | 3/2000 |
| JP | 2001-514985 | 9/2001 |
| JP | 2003-523855 | 8/2003 |
| JP | 2005-280072 | 10/2005 |

* cited by examiner

*Primary Examiner*—Stephen D Meier
*Assistant Examiner*—Alexander C Witkowski
(74) *Attorney, Agent, or Firm*—Fitzpatrick, Cella, Harper & Scinto

(57) ABSTRACT

In an ink supply system for connecting with an ink container with a hollow communicating tube provided in the ink container, in order to prevent leakage of the ink from the communicating tube and simultaneously to prevent damage of the communicating tube projected from the ink container, the communicating tube 60 is made movable to be projected from the inside of the ink container and to be inserted into a recording head, thus establishing liquid communication between the inside of the ink container and the inside of the recording head.

11 Claims, 8 Drawing Sheets

INK CONTAINER AND INK JET RECORDING APPARATUS

This application is a continuation of International Application No. PCT/JP2005/024169, filed Dec. 22, 2005, the entire contents of which are incorporated by reference herein.

TECHNICAL FIELD

The present invention relates to an ink container which stores liquid, such as ink, to be supplied to an ink jet recording head, for example, an ink jet recording apparatus which employs an ink container. In particular, it relates to an ink container which is separable from an ink jet recording head and can be attached to, or detached from, a recording head through a simple operation, and whose connective member for connecting an ink container to a recording head can be highly precisely positioned, and an ink jet recording apparatus which employs such an ink container.

BACKGROUND ART

A recording apparatus, such as an ink jet recording apparatus which forms an image on recording medium by depositing liquid ink on the recording medium with the use of an ink jet recording head, is relatively low in the noise level during a recording operation, can form minute dots on recording medium, and also, can place minute dots on recording medium at a high density. Thus, it has come to be widely used in the field of printing, including the field of color printing. Some ink jet recording apparatuses are provided with: an ink jet recording head, which receives ink from an ink container which is separably attached to the ink jet recording head; a carriage on which the recording head is borne, and which is moved so that the recording head is moved (primary scan) relative to the recording medium in a manner to scan the recording medium in a preset direction; and a conveying means which conveys (secondary scan) the recording medium relative to the recording head in the direction perpendicular to the abovementioned direction in which the carriage is moved. They record an image by jetting ink while moving the recording head in the primary scan direction. Further, some ink jet recording apparatuses can print in full color. In the case of those ink jet recording apparatuses, multiple recording heads capable of jetting black ink, and color inks, such as yellow, cyan, and magenta inks, respectively, are mounted on the carriage so that not only a monochromatic image can be printed (for example, text can be printed using black ink), but also, a full-color image can be printed by varying the ratio at which each ink is jetted.

Presently, the mainstream structural arrangement for supplying the ink jet recording head of an ink jet recording apparatus with ink is such that an ink container having an ink storage portion is independent from a recording means, and also, that both the ink container and recording means are independent (separable) from the main assembly of a recording apparatus, and are attached to the main assembly when they are put to use. In the case of this structural arrangement, the ink passage from the ink storage portion to the recording means is short, and therefore, it is easy to reduce in size a recording apparatus. Also in the case of this structural arrangement, it is only the ink storage portion that needs to be replaced to replenish the recording means with ink. Therefore, this structural arrangement is advantageous in terms of operational cost.

Regarding the structural arrangement for supplying an ink jet recording head with ink, in order for the ink container portion and recording means to be separable from each other, it is desired that the portion of an ink container, by which the ink container is connected to a recording means (this portion of ink container hereafter will be referred to as "connective portion"), simultaneously satisfies at least the following three conditions.

One of the conditions is that the connective portion does not leak ink, regardless of ink container attitude, when the recording means and ink container are in connection with each other (which hereafter will be referred to as "connected state") and also, when the recording means and ink container are not in connection with each other (which hereafter will be referred to as "disconnected state"). The next condition is that the connective portion ensures that the recording means is reliably supplied with ink while the recording means and ink container are in connection with each other. It is possible that a recording means and an ink container will be repeatedly connected to each other or disconnected from each other by a user. Thus, another condition, or the third condition, is that even if a recording means and an ink container are repeatedly connected to each other, or disconnected from each other, the conditions to be satisfied when the two are in the connected or disconnected state, are satisfied each time the two are connected or disconnected.

A couple of structural arrangements that satisfy the abovementioned conditions are disclosed in Japanese Laid-open Patent Applications H07-241998 (Patent Document 1) and 2000-85138 (Patent Document 2). According to these patent applications, a piece of hollow tube is used as a means for connecting an ink container and a recording means in such a manner that liquid can be moved between the ink container and recording means, that is, a means for connecting the interior of the ink container and the interior of an ink jet recording head. As the structural arrangements which use a needle to connect a head and an ink container to each other, those disclosed in Japanese Laid-open Patent Applications H05-229133 (Patent Document 3), H05-254139 (Patent Document 4), H05-270001 (Patent Document 5) may be listed. In the case of the structural arrangements disclosed in Patent Documents 1-5, the gap between the external surface of a tubular member and the counterpart can be easily sealed with an elastic member, such as an O-ring, and further, a large amount of ink can be supplied at a high speed through the tubular member.

In the case of many of the structural arrangements such as those disclosed in Patent Documents 1-5, a connective portion, such as an ink supplying needle, is vertically pointed for the following reason. That is, the ink in an ink container is likely to collect in the bottom portion of the ink container because of gravity. Further, in the case of an ink container structured so that as the ink in the ink container is consumed, the ambient air is drawn into the ink container, the ink outlet of the ink container must be located in the bottom portion of the ink container, because, unless the ink outlet is in the bottom portion of the ink container, a large amount of the ink in the ink container is unusable, being therefore wasted. Therefore, in the case of an ink container structured as described above, its ink outlet is likely to be located in its bottom portion.

Thus, in the case of the structural arrangement in which an ink container and a recording head are connected to each other with the use of a tubular member, and the ink outlet of the ink container is a part of the bottom portion of the ink container, the ink container is mounted into the recording apparatus, from above, in the direction parallel to the direction in which the tubular member extends.

However, the above described example of the structural arrangement for connecting an ink container to an ink jet recording head suffers from the problems which will be pointed out below.

Firstly, since the ink container is mounted into the recording apparatus from above and in the direction parallel to the direction in which the tubular member extends, a certain amount of space must be provided in the adjacencies of the top surface of the recording apparatus when using the apparatus, and also, the recording apparatus must be more or less limited in design. For the purpose of supplying an ink jet recording head with ink at a speed high enough for the high speed printing in future, the tubular member must be larger in internal diameter. However, mounting an ink container into the recording apparatus from above makes it difficult to accurately position the ink container, and therefore, there is a limit to the size of the diameter of the tubular member.

Secondly, in the case of the structural arrangements disclosed in Patent Documents 1-5, a means for sealing the opening of the ink inlet of the tubular (hollow) member when disconnecting the ink container from the ink jet recording head is not provided. Therefore, it is possible that when the ink container is not in connection with the ink jet recording head, the solvent portion of the ink will evaporate through the opening of the ink inlet, changing thereby the ink in properties, and/or foreign substances will enter the ink container through the opening of the ink inlet. It is possible to provide a sealing means which is slidable along the tubular member to seal the opening of the ink inlet. However, not only does this structural arrangement increase component count, but also, the provision of the sealing means requires the ink container to be positioned higher than an ink container with no sealing means, resulting in the increase in the recording apparatus height. Further, in the case of Patent Document 2, the opening of the needle is sealed with a film-like member. In this case, however, as the ink container is attached to the recording head, the sealing film is broken. Therefore, if the ink container is separated from the ink jet recording head before the ink in the ink container is used up, it is possible that the ink will leak through the needle.

Thirdly, what has been in demand is a compact recording apparatus, in particular, a compact recording apparatus which is small in vertical dimension. Therefore, an ink container has been reduced in the height which the ink container has when it is in use. However, an ink container is not to be easily reduced in ink capacity. Accordingly, therefore, an ink container has to be increased in length. Thus, there occurs a situation in which an oblong ink container has to be mounted into a recording apparatus, while being roughly horizontally held. In such a situation, it is even more difficult to align a tubular connective member with the ink outlet. Therefore, misalignment sometimes occurs between the tubular connective member and the ink outlet. If the ink container is mounted, with the tubular connective member remaining misaligned with the ink outlet, ink is likely to leak, and/or sometimes, the tubular connective member breaks because of the force to which it is subjected when it is connected to the ink outlet.

As the means for properly positioning a tubular connective member relative to the ink outlet, it is possible to provide both a recording head and an ink container with a guide to improve them in terms of the accuracy with which they can be positioned relative to each other. However, in consideration of the fact that each ink container is different from the others in terms of the component dimension, the guides need to be structured so that a minute gap is provided between them. This gap inevitably makes it possible for the tubular connective member and ink outlet to become misaligned by the amount equal to the amount of the gap.

Fourthly, in the case of the structural arrangement disclosed, as the third embodiment, in Patent Document 2, in which an ink delivery needle is provided as a part of an ink container, a protective member, such as a guiding cylinder, must be provided for user protection, and also, for preventing the needle from being damaged. This increases an ink container in size. Further, if a guiding cylinder is provided, it is possible that the guide cylinder itself becomes damaged due to a fall or the like.

DISCLOSURE OF THE INVENTION

The present invention is the result of the attention given to the technical problems described above, and the earnest studies made to solve these problems. According to the present invention, there is provided an ink container containing ink to be supplied to an ink jet recording head provided in an ink jet recording apparatus, said ink container comprising:

an ink containing portion for directly containing the ink;

an opening for fluid communication with an ink introduction opening of said recording head; and a communicating tube insertable and retractable relative to the ink introduction opening;

wherein said communicating tube has an ink flow path which establishes fluid communication between said ink containing portion and said recording head to supply the ink into the recording head when said communicating tube is inserted into the ink introduction opening through said opening, and said ink flow path prevents fluid communication between said ink containing portion and an outside when it is accommodated in said ink container.

In addition, it further comprises an elastic member provided between said ink container and said communicating tube, the elastic member urging said communicating tube in a direction of accommodating at least said ink flow path.

In addition, the ink jet recording apparatus is provided with an urging member for pushing said communicating tube outwardly through said opening against an urging force of said elastic member, and said ink container includes an insertion opening for permitting pushing of said communicating tube by said urging member.

Furthermore, it further comprises a sealing member for preventing the ink in said ink containing portion from leaking out through said opening and said insertion opening of said ink container.

In addition, said communicating tube faces said insertion opening and is capable of being directly pushed by said urging member.

In addition, it further comprises a sheet member of flexible material provided in said insertion opening, wherein said communicating tube is capable of being pushed by said urging member through said sheet member.

In addition, wherein the urging member of said ink jet recording apparatus is movable with a mounting operation of said ink container, and an outer casing of said ink container is provided with a guide for moving said urging member.

In addition, said opening of said ink container is provided in a side thereof which is a bottom side in use.

In addition, said ink containing portion of said ink container includes a flexible sheet member and an elastic member and an ambient air introduction mechanism for introducing ambient air into said ink containing portion from an outside of said ink container in accordance with a state of said ink containing portion, wherein ink containing portion directly contains the ink.

Furthermore, said ink containing portion contains, when said ink container is not mounted to said ink jet recording apparatus, the ink with a pressure which is equivalent to or higher than a pressure when said ink container is mounted and is operated.

Additionally, there is provided an ink jet recording apparatus comprising:

an ink container mounting portion for mounting said ink container, wherein said ink container includes, an ink containing portion for directing containing ink to be supplied to an ink jet recording head provided in said ink jet recording apparatus, an opening in fluid communication with an ink introduction opening of said recording head, and a communicating tube which is insertable and retractable relative to the ink introduction opening and which is provided with an elastic member, between said communicating tube and said ink container, for urging said communicating tube in a direction of accommodating said communicating tube in said ink container; and an insertion opening for permitting an external operation transmission for operation of said communicating tube, wherein said communicating tube has an ink flow path which established fluid communication between said ink containing portion and said recording head to supply the ink into the recording head when said communicating tube is inserted into the ink introduction opening through said opening; said ink flow path prevents fluid communication between said ink containing portion and an outside when it is accommodated in said ink container; and an urging member for pushing said communicating tube outwardly through said opening against an urging force of said elastic member provided in said ink container.

Here, said urging member is independently operated after mounting of said ink container to said mounting portion to push said communicating tube of said ink container, or said urging member is provided with a guide contact member engageable with a guide to enable an operation along the guide provided on an outer casing of said ink container.

DETAILED DESCRIPTION OF THE PREFERRED EMBODIMENTS

Hereinafter, the ink jet recording apparatus in the most desirable embodiment of the present invention will be described with reference to the appended drawings.

In this specification, "recording" does not mean only "forming a meaningful image", such as a letter or figure. It also means "forming a meaningless image as well as a meaningful image". Further, it does not means only "making information visually recognizable, such as forming an image of a specific object, an image for a specific pattern, etc., on recording medium", but also, "processing the recording medium".

"Recording medium" does not mean only the paper used with an ordinary recording apparatus. That is, it means any substance which is capable of accepting ink. In other words, it includes a wide range of substances, for example, fabric, plastic film, metallic plate, glass, ceramic, lumber, leather, etc. Incidentally, in the following description of the preferred embodiments of the present invention, "recording medium" may be referred to as "recording paper" or simply "paper".

Incidentally, in this specification, the liquid supplying system in accordance with the present invention is described with reference to ink as the liquid supplied by the system. However, the liquid which can be supplied by the liquid supplying system in accordance with the present invention is not limited to ink. For example, it includes the liquid used for processing recording medium in the field of ink jet recording, which is obvious.

Embodiment 1

Figure 1:
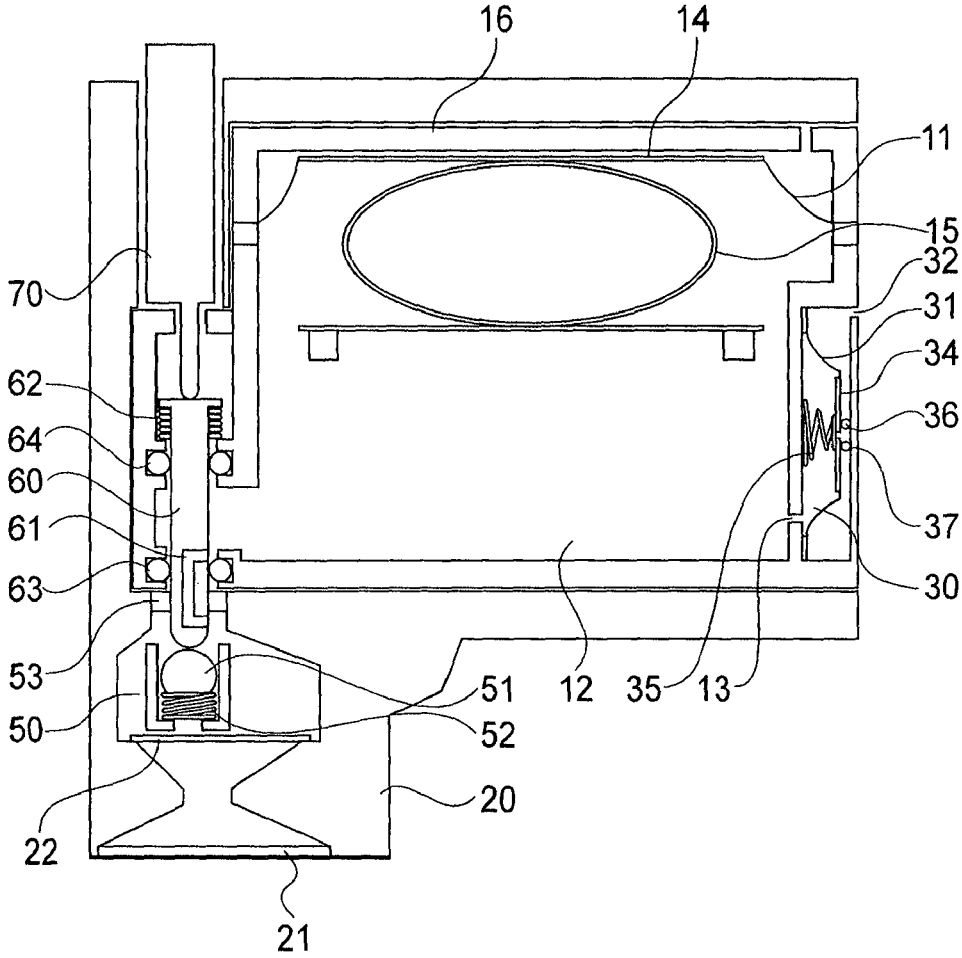
FIG. 1 is a schematic sectional view of the ink container and recording head, in the most desirable embodiment of the present invention, which are in the properly connected state.
Figure 2:
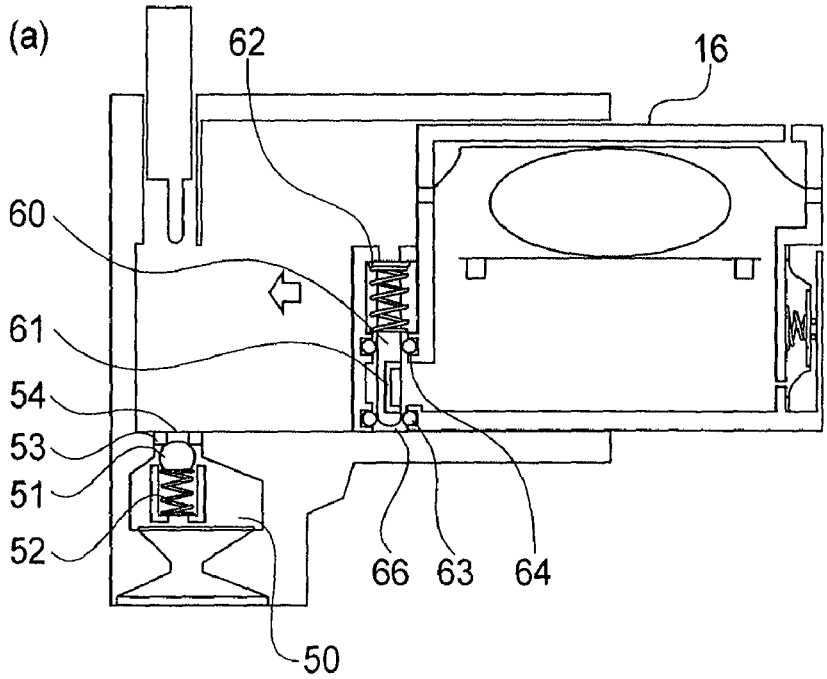
FIGS. 2(*a*) and 2(*b*) are schematic sectional views of the ink container and recording head, in the most desirable embodiment of the present invention, showing the process of mounting the ink container into the recording head.
Figure 2:
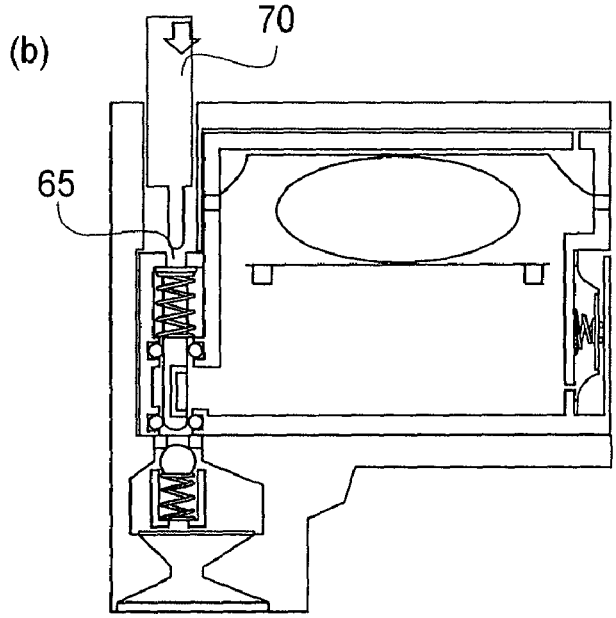
Figure 3:
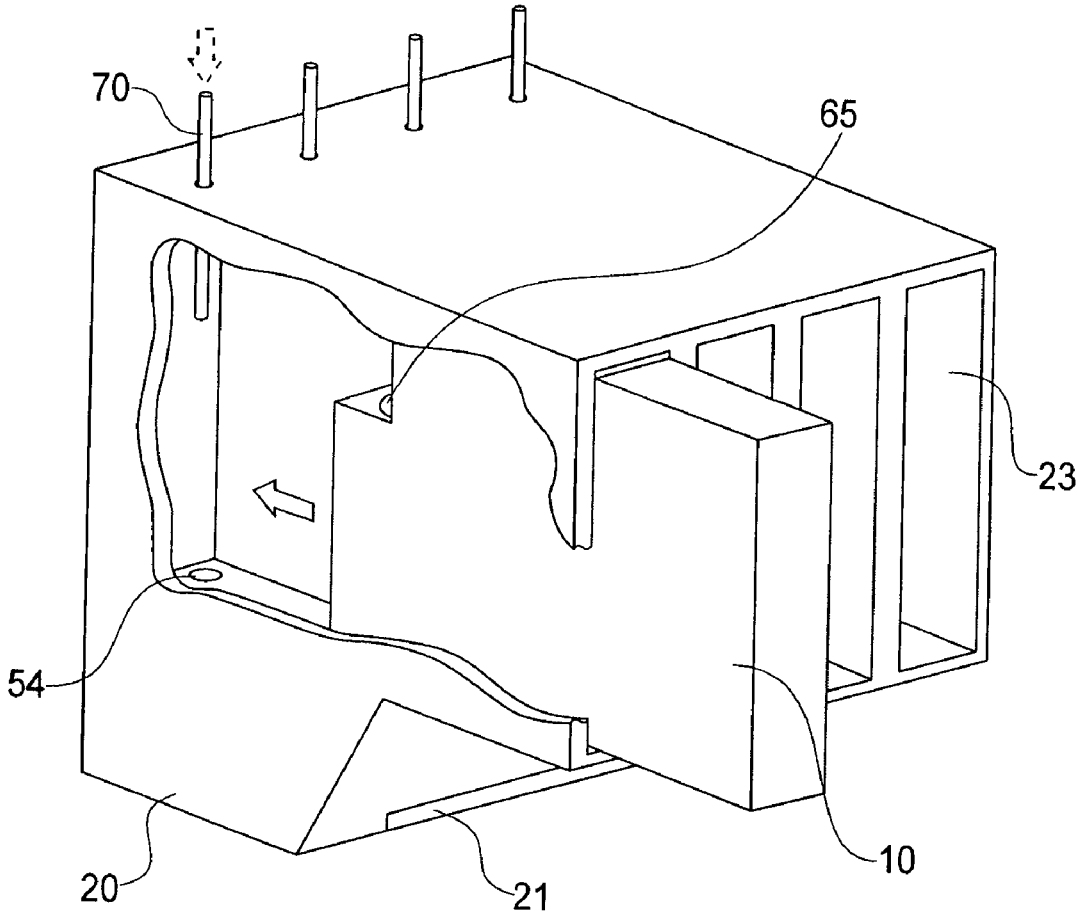
FIG. 3 is a perspective view of the recording head and ink container, in the most desirable embodiment of the present invention, showing the process of mounting the ink container into the recording head.

First, referring to FIGS. 1, 2(*a*) and 2(*b*), the most desirable embodiment of the recent invention will be described. FIG. 1 is a schematic sectional view of the ink container and recording head, which are in the properly connected state. FIGS. 2(*a*) and 2(*b*) are schematic sectional views of the ink container and recording head, showing the process of connecting the ink container to the recording head. FIG. 3 is a perspective view of the recording head and ink container, showing the step (shown in FIG. 2(*a*)) for connecting the ink container to the recording head. In FIG. 3, however, a part of one of the lateral walls of the recording head has been cut away for describing the step.

Referring to FIG. 1 which depicts the most desirable embodiment of the present invention, the recording unit is made up of an ink container 10, as a liquid container, and an ink jet recording head 20 (which hereafter will be referred to simply as "recording head"). As for the ink delivery route, the ink stored in the ink storage chamber 12 of the ink container 10 flows through an ink passage 61 in a connective tube 60, reaching a liquid chamber 50 in the recording head 20, and then, reaches an ink jetting portion 21 through a filter 22. Then, the ink jetting portion 21 records an image on recording medium by jetting the ink.

At this time, the process of connecting the ink container 10 and recording head 20 to each other will be described. FIG. 2(*a*) shows the ink container 10, and the recording head 20, into whose ink container mounting compartment the ink container 20 is being inserted to connect the ink container 10 to the recording head 20. FIG. 3 is a perspective view of the ink container 10 and recording head 20, which are in the same state as they are in FIG. 2(*a*). The ink container 10 is to be inserted into the ink container mounting compartment of the recording head 20 through the opening of the ink container mounting compartment 23. The ink container insertion direction is perpendicular to the ink jetting direction. The ink container replacement operation can be carried out from the front side of the recording apparatus, as will be described later in detail when the recording apparatus is described later with reference to FIG. 7. Further, this structural arrangement makes it natural for a user to insert the ink container 10 in such a manner that the ink container 10 follows the bottom surface of the ink container mounting compartment 23. Therefore, this structural arrangement can minimize the deviation of the ink container in terms of the vertical direction. For the purpose of precisely positioning each ink container 10 in terms of the direction perpendicular to FIG. 2, the ink container mounting compartment 23 may be provided with partitioning walls as shown in FIG. 3. Further, the partition walls of the ink container mounting compartment 23 may be provided with guides to more precisely position each ink container.

The ink outlet 66 of the ink container 10 remains sealed with a columnar (cylindrical) connective tube 60 and a connective tube sealing member A63. The sealing members 63 are elastic members which are in the form of an O-ring or the like, and seal the gaps between the connective tube 60 and the shell 16 of the ink container 10. The opposite end portion of the connective tube 60 from the end portion which seals the ink outlet 66 is protruding from the ink storage chamber 12, and the gap between this portion of the connective tube 60 and the shell 16 of the ink container 10 remains sealed with a connective tube sealing member B64 as does the gap between the other end and the shell 16 of the ink container 10 remains sealed with the connective tube sealing member A63. Thus the ink storage chamber 12 remains hermetically sealed. The connective tube 60 is provided with a hole as an ink passage 61. When the connective tube 60 in the ink container shell 16, both of the openings of the ink passage 60 are in connection to the ink storage chamber 12. The connective tube 60 is under the pressure from a connective tube spring 62, which keeps the connective tube 60 pressed upward in the drawing. However, the top end of the connective tube 60 is in contact with the ink container shell 16, remaining thereby stationary relative to the ink container shell 16. The ink container 10 is structured so that when the ink container 10 is in this state, the bottom end portion of the connective tube 60 is in the ink outlet 66, and is not protruding outward from the bottom wall of the ink container shell 16. Therefore, the connective tube 60 does not come into contact with the bottom wall of the ink container mounting compartment 23 while the ink container 10 is inserted into the ink container mounting compartment 23; it does not interfere with the mounting of the ink container 10.

The recording head 20 is provided with a pressing member 70, which is in connection with a motor of the recording apparatus. The pressing member 70 is movable in the height direction of the drawing. The pressing member 70 can be smoothly inserted into a pressing member insertion hole 63. The recording head 20 is provided with an ink inlet 54, which remains sealed by the combination of a spherical sealing member 51, a sealing spring 52, and an ink inlet sealing member 53 which is an elastic member formed of rubber or the like: the spherical sealing member 51 is kept pressed upon the ink outlet sealing member 53 by the sealing spring 52. Thus, the liquid chamber 50 remains sealed, although it is in connection to the ink jetting portion 21. Therefore, even if the liquid chamber 50 is full of ink, ink does not leak from the ink jetting portion. Further, the sealing member 51 is movable in the downward direction in the drawing, making it possible for the ink inlet 54 to be opened or closed.

FIG. 2(*b*) shows the state of the ink container 10 and recording head 20, which occurred when the ink container 10 was inserted all the way into the ink container mounting compartment 23 in the direction indicated by an arrow mark in FIG. 2(*a*). When the ink container 10 and recording head 20 are in this state, the bottom end of the pressing member 70 is in alignment with the pressing member insertion hole 65, and also, the ink outlet 66 is in alignment with the ink inlet 54. Also when the ink container 10 and recording head 20 are in the state shown in the drawing, the positional relationship between the ink container 10 and recording head 20 is set by the ink container shell 16 and the inward surface of the ink container mounting compartment 23 of the recording head 20. However, the ink container mounting compartment 23 of the recording head 20 may be provided with an ink container stopping member (unshown) so that the ink container 10 and recording head 20 become properly positioned relative to each other as the ink container 10 comes into contact with the ink container stopping member. It is desired that when the ink container 10 and recording head 20 are in the above mentioned state, the axial line of the pressing member 70 coincides with the axial line of the connective tube 60.

When the ink container 10 and recording head 20 are in the abovementioned condition, the connective tube 60 and sealing member 51 are to be moved by moving the pressing member 70 in the direction indicated by an arrow mark in FIG. 2(*b*). However, it is desired that before starting this movement, it is checked, by an electrical contact or the like, whether or not the ink container is in the preset position. It is possible to design the recording apparatus so that if it is determined that the ink container position is improper, a user can be warned and prompted to properly reinsert the ink container 10.

FIG. 1 shows the state of the ink container 10 and recording head 20, which has occurred as the ink container 10 and recording head 20 have become completely connected by the completion of the movement of the pressing member 70. The movement of the pressing member 70 caused the connective tube 60 to move downward, causing thereby the connective tube 60 to move into the liquid chamber 50. As a result, the opening, which the bottom end portion of the ink passage 61 has, enters the liquid chamber 50, connecting thereby the ink storage chamber 12 and the liquid chamber 50 of the recording head, because the opening, which the other end portion of the ink passage 61 has, is in connection with the ink storage chamber 12. It is desired that the pressing member 70 is moved so that at the end of the movement of the pressing member 70, the top opening of the ink passage 61 is on the ink storage chamber side, relative to the sealing portion of the connective tube sealing member A63, and also, so that the opening is near the bottommost surface of the ink storage chamber 12. The reason for this desire is that if the opening of the ink passage 61 is at a level higher than the bottommost surface of the ink storage chamber 12, a certain amount of the ink in the ink storage chamber 12 fails to be consumed.

Moving the pressing member 70 after detecting the ink container position can prevent the connective tube from being inserted when there is the misalignment. Thus, it prevents the connective tube 60 from being subjected to an excessive amount of load, ensuring that the connective tube 60 withstands the process of mounting the ink container in spite of the repetition of the process. Further, the connective tube 60 is supported by the connective tube sealing members A63 and B64, which are elastic members, being thereby enabled to tolerate the misalignment, as long as it is relatively small, and allowing the ink container 10 to slightly move while the pressing member 70 is moved. In other words, the provision of the connective tube sealing members, which are elastic members, allows the elasticity of the connective tube sealing members to automatically move the ink container 10 into its correct position. This operation of moving the pressing member 70 may be carried out any time between immediately after the completion of the insertion of the ink container by a user and before the actual process of recording an image is started. Further, during the actual process of recording an image, the pressing member 70 remains inserted in the pressing member insertion hole 65, preventing thereby the ink container from being extracted by the user when the ink container is in the improper state for extraction.

Next, the ink supplying mechanism, which functions when the ink container is in connection with the recording head as described above, will be described, including the working of the ink container.

Generally, the ink container 10 is made up of two chambers, that is, the abovementioned ink storage chamber 12, and a valve chamber 30. The ink storage chamber 12 provides an ink storing space. The internal spaces of the two chambers are in connection with each other through a passage 13. The ink to be jetted out of the recording head is stored in the ink storage chamber 12, and is supplied to the recording head in response to the ink jetting operation of the recording head.

A part of the ink storage chamber 12 is provided with a flexible film 11 (sheet). The space between this portion and the inflexible shell 16 of the ink container constitutes the ink storage space. The space on the top side of the sheet 11 is in connection to the ambient air, and therefore, its pressure is the same as the atmospheric pressure. On the other hand, the ink storage space remains virtually sealed, although it has the connective portion by which the ink container is connected to the connective portion 51 of the liquid chamber 50 located below, and also, it has the passage 13 to the valve chamber.

The center portion of the sheet 11 in this embodiment is regulated in shape by a pressure plate 14, as a sheet supporting member, which is in the form of a piece of flat plate. Thus, only the peripheral portions of the sheet 11 are allowed to change in shape. Further, the sheet 11 is shaped in advance so that its center portion, that is, the portion which corresponds to the pressure plate 14, protrudes upward in the drawing. In other words, the sheet 11 is shaped so that in side view, the sheet 11 appears like a trapezoid. The sheet 11 deforms in response to the changes in the amount of the ink in the ink storage space, and the changes in pressure, as will be described later. As it deforms, its peripheral portions evenly stretch or shrink, allowing thereby its center portion to move in the vertical direction in the drawing while remaining virtually horizontal. In other words, the sheet 11 smoothly deforms (moves). Therefore, there is no impact attributable to the deformation of the sheet 11. Therefore, it does not occur that the ink storage space is abruptly changed in pressure by the impact attributable to the deformation of the sheet 11.

In the ink storage space, a compression spring 15 is provided, which applies upward pressure (in drawing) to the sheet 11 through the pressure plate 14 to generate such an amount of negative pressure that allows the recording head to jet ink while balancing the ink retaining force of the meniscus formed in the ink jetting portion of the recording head. Thus, as the air in the ink storage chamber changes in volume because of the changes in the ambient conditions (changes in ambient temperature and atmospheric pressure), the changes are absorbed by the deformation of the spring and sheet, preventing thereby the negative pressure in the chamber from substantially changing. Incidentally, when the ink container 10 is in the state shown in FIG. 1, the ink storage space is virtually full of ink. Even when the ink container 10 is in the state shown in FIG. 1, the spring 15 remains compressed, providing the ink storage space with a proper amount of negative pressure.

In the valve chamber 30, a one-way valve is provided, which is for introducing gas (air) into the ink storage space from the outside, as the negative pressure in the ink container 10 becomes higher than a preset value, and also, preventing the ink from leaking from the ink container 10. This one-way valve is made up of a pressure plate 34, a sealing member 37, and a sheet 31. The pressure plate 34 has a through hole 36 and functions as a valve closing member. The sealing member 37 is fixed to the inward surface of the valve chamber shell in a manner to surround the edge of the through hole 36, being enabled to seal the through hole 36. The sheet 31 is attached to the pressure plate 34, and has a through hole which is in alignment with the through hole 36. Thus, the valve chamber 30 also remains virtually sealed, although it has the through hole 13 which leads to the ink storage chamber 12, and the through hole 36 which leads to the ambient air. The portion of the internal space of the valve chamber shell, which is on the right-hand side of the sheet 31 in the drawing, is open to the ambient air (atmospheric air) through an air vent 32, being therefore equal in pressure to the ambient air.

The peripheral portions of the sheet 31, that is, the portions other than the center portion of the sheet 31, by which the sheet 31 is attached to the pressure plate 34, are deformable. The sheet 31 is attached so that its center portion protrudes outward from the shell 16; in side view, it appears roughly trapezoidal. The employment of the above described structural arrangement allows the pressure plate 34, as the valve closing member, to smoothly move leftward or rightward in the drawing.

In the valve chamber 30, a spring 35 is provided, which is a valve regulating member for regulating the opening or closing movement of the valve. The spring 35 is also kept slightly compressed in order to keep the pressure plate 34 pressed rightward in the drawing by the reactive force resulting from the slight compression of the spring 35. In other words, the extension of this spring 35 causes the sealing member 37 to hermetically seal the through hole 36, and the compression the spring 35 allows the sealing member 37 to separate from the valve chamber shell; these components make up a one-way valve mechanism, which allows the gas (air) to enter the valve chamber 30 through the air vent 32 and through hole 36.

Incidentally, all that is required of the sealing member 37 is to be reliable in hermetically sealing the through hole 36. More specifically, it has only to be shaped so that its surface which comes into contact with the area of the surface of the pressure plate 34, which surround the through hole 36, is flat, or provided with ribs, which come into contact with the edge area of the through hole 36 in a manner to hermetically seal the through hole 36. Further, the sealing member 37 may be shaped so that its tip can be inserted into the through hole 36 to seal the through hole 36. In other words, all that is required of the sealing member 37 is that it is shaped so that it can hermetically seal the through hole 36. Further, the material for the sealing member 37 does not have to be limited to the one used in this embodiment. However, the hermetical sealing of the through hole 36 is accomplished by the resiliency of the spring 35, which acts in the direction to lengthen the spring 35. Thus, it is preferable that the material for the sealing member 37 is formed of such a substance that allows the sealing member 37 to easily conform to the sheet 31 and pressure plate 34 which are moved by the resiliency of the spring 35. That is, it is preferable that the sealing member 37 is formed of an elastic substance, such as rubber, which is compressible.

The various portions of the ink container 10 in this embodiment are designed so that as the ink in the ink container 10 is consumed, the following actions will occur. That is, when the ink container 10 structured as described above is in the initial stage of its usage, that is, when the ink container 10 is used for the first time, it is full of ink. Then, as the ink is consumed, the negative pressure is developed in the ink storage chamber 12, and continues to increase, eventually exceeding the amount of force which is being applied to the pressure plate 34 by the valve regulating member in the valve chamber 30. The moment when the amount of the negative pressure in the ink storage chamber 12 exceeds the amount of pressure applied by the valve regulating member, the through hole 36 becomes unsealed, allowing the atmospheric air to flow into the ink storage space. As the ambient air flows into the ink storage space, the volumetric change of the ink storage space reverses in direction, that is, it increases in volume, because the ink storage space can be increased in volume by the upward deformation of the sheet 11 or/and the upward displacement of the pressure plate 14. At the same time, the ink storage space reduces in negative pressure, allowing the through hole 36 to be sealed.

Further, the body of air in the ink storage space is allowed to expand by an amount equal to the amount of volume which the sheet 11 and pressure plate 14 displace as they move from their initial positions to their bottommost position to which they are displaceable. In other words, the theoretical space which is equal in volume to the abovementioned space displaceable by the movement of the sheet 11 and pressure plate 14 functions as a buffer space. Therefore, even if the ambient conditions of the ink container change, for example, even if the ambient temperature of the ink container increases and/or the ambient pressure changes, this theoretical space can effectively prevent the ink from leaking through the ink jetting orifices.

As liquid is drawn out of the ink container which is in its initial state, that is, being full of ink, the ink storage space reduces in internal volume. However, until the buffer space is secured, the ambient air is not introduced. Therefore, even if the ambient conditions suddenly changes and/or the ink container is vibrated or dropped, it is unlikely for the ink to leak. Further, there is no buffer space prior to the first time usage of the ink container, that is, the ink container does not need to be provided in advance with the buffer space. Therefore, the ink container in this embodiment is higher in the volumetric ratio of the space in which ink is actually storable. Thus, the ink container in this embodiment can be rendered smaller in size than an ink container in accordance with the prior art, provided that the two are the same in liquid (ink) capacity.

Incidentally, the ink container 10 is structured so that the amount of pressure which the ink storage portion has when the ink container 10 is full of ink and not in the ink jet recording apparatus, is roughly the same as the amount of pressure which the ink storage portion has when the ink container 10 is functioning in the ink jet recording apparatus. Therefore, it does not occur that when the ink container is left alone, for example, during its distribution, air is accidentally drawn into the ink storage space through the through hole 36.

The ink supply passage in the liquid chamber 50 is shaped so that it gradually increases in cross section from the junction between the ink container and recording head (upstream side) to a certain point, and then, gradually decreases toward the recording head 20 (downstream). The portion of the ink supply passage, which is largest in cross section, is provided with a filter 22, preventing thereby the impurities in the supplied ink from flowing into the recording head 20.

The recording head 20 is provided with multiple ink jetting orifices arranged in a preset direction (which is different from the direction in which the recording head, which employs the serial recording method and is mounted on a member, such as a carriage, is moved relative to recording medium while jetting ink); multiple liquid passages leading to the multiple ink jetting orifices, one for one; and multiple elements which are placed in the liquid passages, one for one, to generate the energy used for jetting ink. Incidentally, there is no specific limitation to the method employed by the recording head to jet ink, that is, the choice of the energy generating element. For example, an electro-thermal transducer, which generates heat as electric current is flowed through it, may be employed so that the thermal energy generated by the electro-thermal transducer can be used for jetting ink. In such a case, ink is made to boil by the heat generated by the electro-thermal transducer, and the ink is jetted through the ink jetting orifice by the mechanical energy generated by bubble growth. Further, an electromechanical transducer, such as a piezoelectric element, which deforms in response to the voltage applied thereto, may be employed to use the mechanical energy to jet ink.

The recording head 20 and liquid chamber 50 may be separable, or inseparably integral, or they may be completely independent from each other and connectible by a member having an ink passage. Further, they may be integrated in the form of a cartridge removably mountable in (or on) a member, such as a cartridge carriage, in the recording apparatus.

One of the recording apparatus features which characterize the present invention is that the ink container 10 is provided with the connective tube 60, which is disposed in the ink container 10 in such a manner that the connective member 60 can be guided into the recording head by the function of the pressing member, as in the embodiment described above. Further, even though it is the ink container that is provided with the connective tube, the connective tube does not protrude beyond the ink container shell, unless the ink container is put to use. Therefore, not only can it be ensured that the ink inlet does not leak the ink, but also, the connective tube can be prevented from suffering from such damages that might occur as the ink container is dropped. Further, the present invention can reduce an ink container in overall size. Further, an ink container in accordance with the present invention can be mounted into a recording apparatus from the front side of the recording apparatus, even though its ink outlet is a part of the bottom wall of the ink container. Therefore it is possible to place certain things on the top surface of the recording apparatus. Further, a user instinctively makes the ink container follow the bottom surface of the ink container mounting compartment as the user inserts the ink container. Therefore, the ink container is more precisely positioned in terms of its height direction. Further, even if the pressing member and connective tube are slightly misaligned when the connective tube is guided into the ink container by the movement of the pressing member, the resiliency of the elastic member causes the axial line of the pressing member to coincide with that of the connective tube; the misalignment is corrected. Further, the present invention makes it unnecessary to employ complicated components and structural arrangement in order to keep hermetically sealed to prevent the decline in ink supply performance, which is attributable to the evaporation of ink solvent and/or adhesion of solidified ink, when the ink container is not in connection with the recording head. Moreover, the operation for connecting the ink container to the recording head can be carried out after detecting the ink container position to reduce the amount of load to which the connective tube is subjected. Therefore, not only the ink container in accordance with the present invention is more durable, but also, smaller in the amount of force to be applied by a user to connect the ink container to the recording head, being therefore better in operability, than an ink container in accordance with the prior art.

Embodiment 2

Next, referring to FIGS. 4(*a*), 4(*b*), and 4(*c*), FIG. 5, and FIG. 6, the structural arrangement which makes it possible to move the pressing member with the use of a spring in the recording head, that is, without using the motive power generated by a motor or the like in the recording apparatus, will be described.

Figure 4:
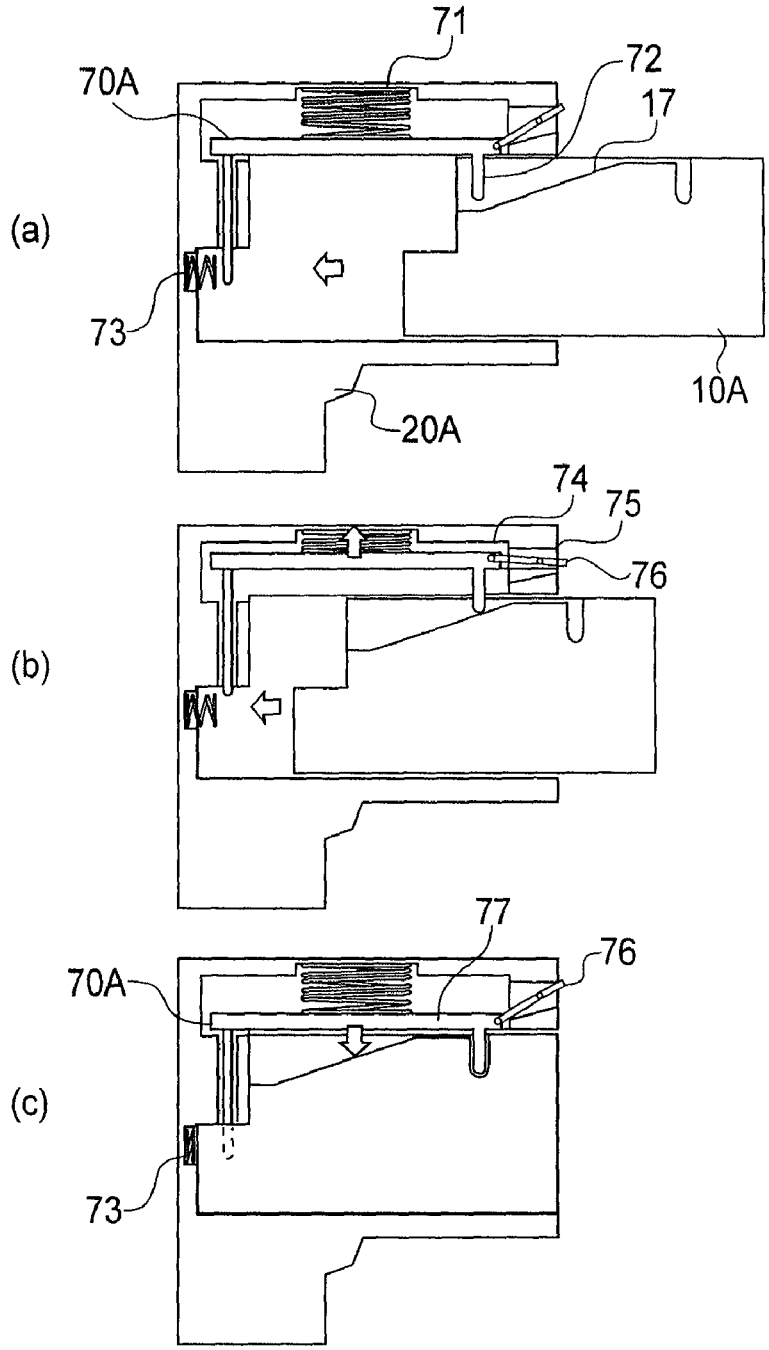
FIGS. 4(*a*)-4(*c*) are schematic sectional views of the ink container and recording head, in the second embodiment of the present invention, showing the process of mounting the ink container into the recording head.
Figure 5:
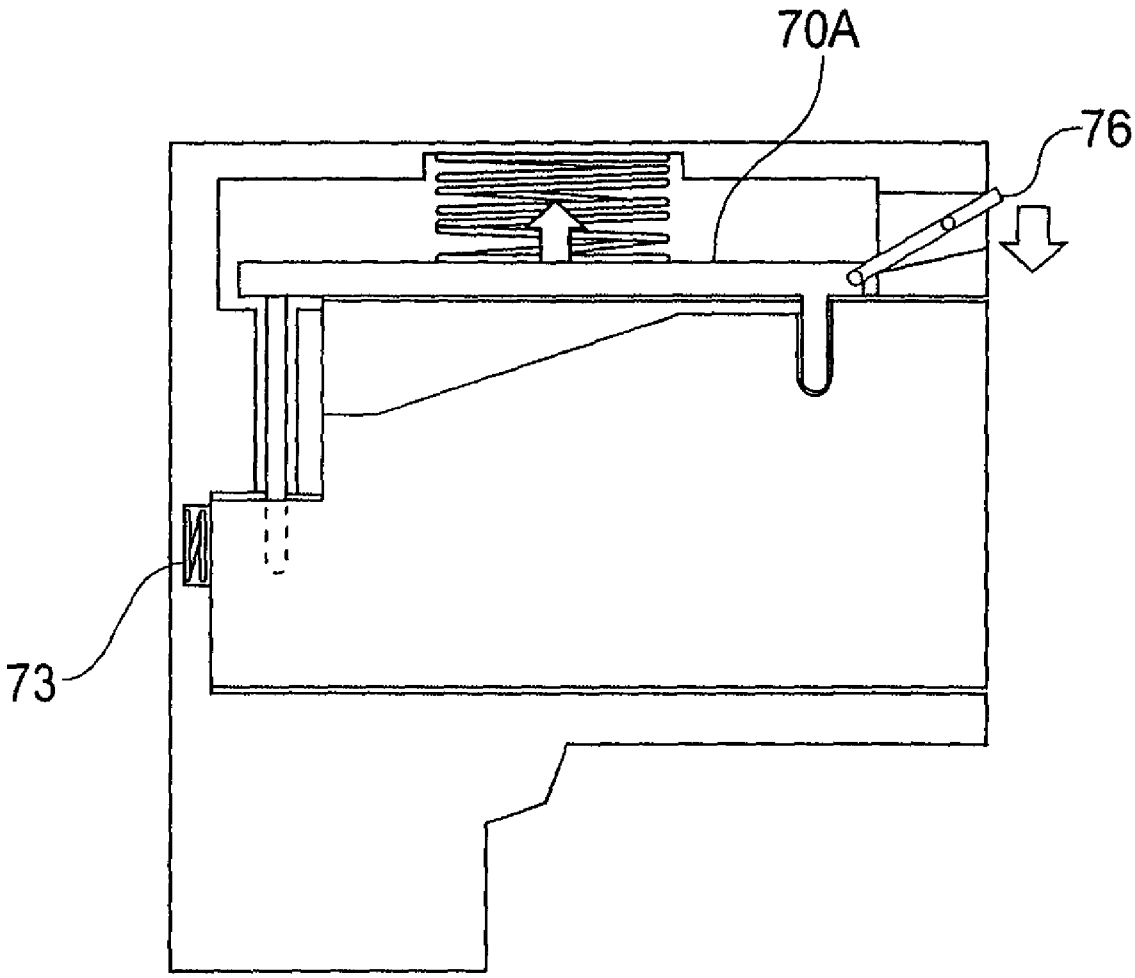
FIG. 5 is a schematic sectional view of the ink container and recording head, in the second embodiment of the present invention, showing the process of extracting the ink container from the recording head.

FIG. 4(*a*) is a schematic sectional view of the ink container and recording head, showing the process of inserting the ink container into the recording head while keeping the ink container in contact with the bottom surface of the ink container mounting compartment 23.

A pressing member 70A is kept downwardly (in drawing) pressed by a pressure application spring 71. Thus, the portion of the pressing member 70A, which is to be inserted into the ink container to press the connective tube remains protruding. Further, the pressing member 70A is provided with a projection 72, whereas the shell of an ink container 10A is provided with a slide guide 17 which corresponds to the projection 72. FIG. 6 is a schematic perspective view of the ink container and recording head, showing the state of engagement between the projection 72 and slide guide 17. For descriptive convenience, FIG. 6 primarily shows only the ink container 10A and pressing member 70A (other components are not shown). As is evident from the drawing, the shell of ink container 10A is provided with a stepped portion as the slide guide 17. The pressing member 70A and ink container 10A are structured to allow the projection 72 to straddle the ink container 10A so that the projection 72 engages with the slide guide 17. As the ink container 10A is inserted, the projection 72 follows the slide guide 17, causing thereby the pressing member 70A to move upward.

Figure 6:
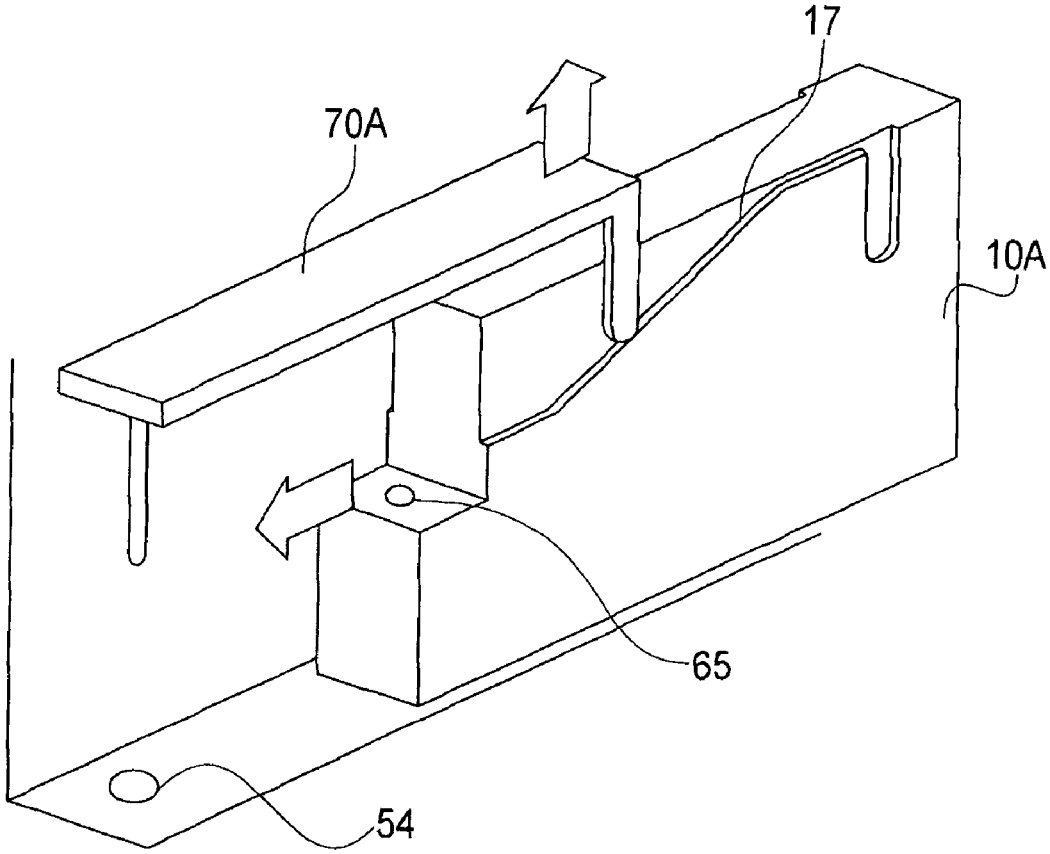
FIG. 6 is a perspective view of the ink container and recording head, in the second embodiment of the present invention, showing the process of mounting the ink container into the recording head.

FIG. 4(*b*) is a schematic sectional view of the ink container and recording head, showing the state in which the projection 72 is in engagement with the slide guide 17, as shown in FIG. 6, and the pressing member 70A is being displaced upward. In this state, as the ink container 10A is inserted, the projection 72 is pressed by the slanted surface of the slide guide 17, causing thereby the pressing member 70A to displace upward against the pressing spring. Further, as the pressing member is displaced upward, an extracting member 74 is rotated about a supporting point 75, causing thereby an extraction switch 76 to downwardly displace. In addition, as the pressing member 70A is displaced, the pressing portion of the pressing member 70A, which is projecting from the ceiling of the ink container mounting compartment of the recording head 20A as shown in FIG. 4(*a*), is retracted.

FIG. 4(*c*) is a schematic sectional view of the ink container 10A and recording head 20A, which are properly in connection with each other.

In this state, the projection 72 is in the groove of the slide guide 17, and the pressing member 70A is back in its initial position shown in FIG. 4(*a*). However, the ink container 10A is in the position in which it is in engagement with the recording head 20A as shown in FIG. 4(*c*). Therefore, the pressing portion of the pressing member 70A is in its preset position, in the ink container 10A, into which it is inserted through a pressing member insertion opening 65, keeping thereby the connective tube (unshown) downwardly pressed as shown in FIG. 1. An extraction spring 73 remains compressed by the ink container 10A. The extraction spring 73 is a spring for sliding the ink container 10A frontward of the recording apparatus to improve the recording apparatus in terms of the operability in an ink container replacement operation. However, it is not an indispensable component. Reducing the friction between the ink container and the bottom surface of the ink container mounting compartment can reduce the amount of force necessary to slide the ink container, making it possible to employ a weaker spring as the ink container extraction spring 73. The placement of the ink container 10A in the state shown in FIG. 4(*c*) concludes the operation for mounting the ink container 10A, readying thereby the recording apparatus for printing.

Next, referring to FIG. 5, the method for extracting the ink container 10A will be described.

As the ink container 10A in the recording apparatus becomes empty due to the consumption of the ink therein by a recording operation, the ink container 10A is replaced. First, an extraction switch 76 is to be moved in the direction indicated by an arrow mark. As the extraction switch 76 is moved, the movement of the extraction switch 76 displaces the pressing member 70A upward, causing the projection 72 to disengage from the slide guide 17. As the projection 72 disengages from the slide guide 17, the ink container 10A is slid by the resiliency of the extraction spring 73, being made easier to be replaced.

That is, in the preceding embodiment described before, the motive force generated by a motor or the like of the recording apparatus was utilized for the operation for engaging or disengaging the connective tube. In comparison, this embodiment is characterized in that the operation for inserting the ink container into the ink container mounting compartment is utilized to automatically insert the connective tube into the recording head with the use of the pressing spring in the recording head. Therefore, this embodiment makes it unnecessary to transmit the motive force of the motor, making it possible to reduce the component count of the recording apparatus.

Embodiment 3

Next, referring to FIGS. 7(*a*) and 7(*b*), the embodiment of the present invention, in which the connective tube is structured differently from those in the preceding embodiments, will be described.

Figure 7:
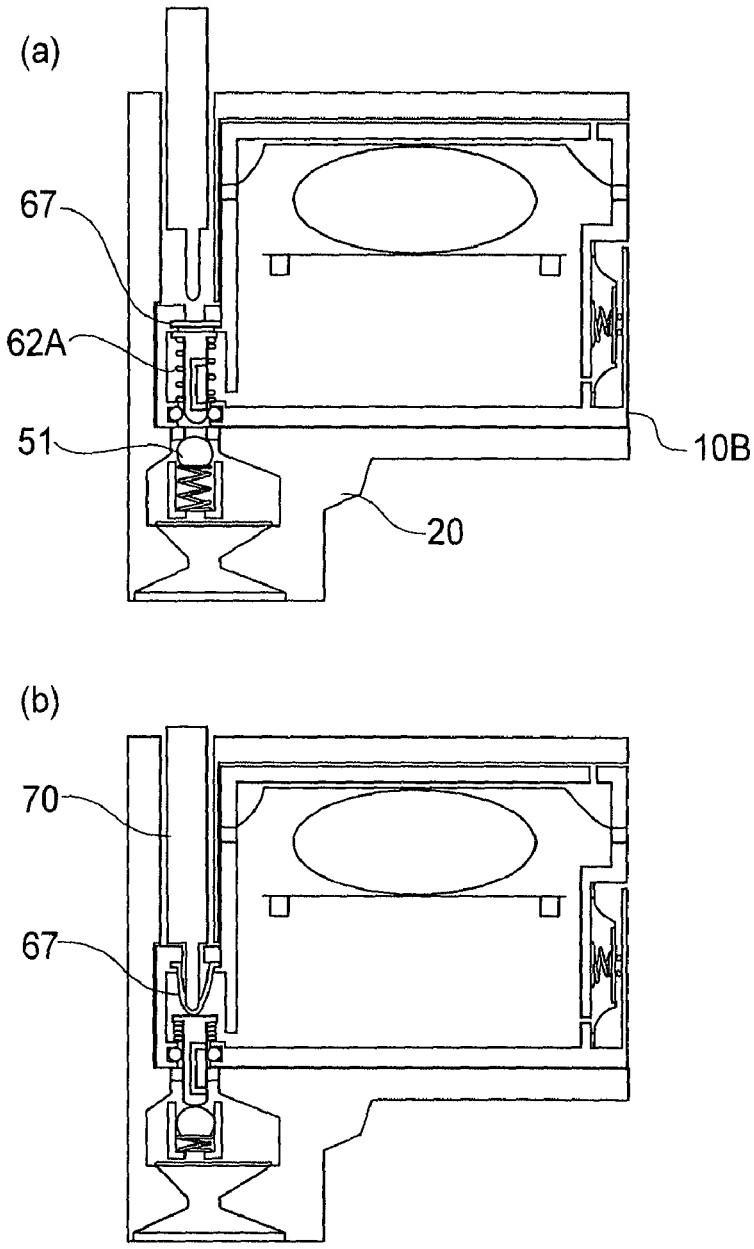
FIGS. 7(*a*) and 7(*b*) are schematic sectional views of the ink container and recording head, in the third embodiment of the present invention, showing the process of mounting the ink container into the recording head.

FIG. 7(*a*) is a schematic sectional view of the ink container and recording head, which are in the state in which the insertion of the ink container has just been completed. FIG. 7(*a*) corresponds to FIG. 2(*a*) which shows the most desirable embodiment of the present invention. This embodiment is different from the most desirable embodiment in that the top end portion (in the drawing) of the connective tube 60A in this embodiment is not protruding from the ink storage chamber 12, and a connective spring 62A is in the ink storage chamber 12. Therefore, the connective portion of the ink container 10B in this embodiment is more compact than the connective portion of the ink container 10 shown in FIG. 1.

FIG. 7(*b*) is a schematic sectional view of the ink container and recording head, which are in the state in which the connective tube 60A has just been moved by the pressing member 70, connecting thereby the ink container 10B and recording head 20 so that the ink can be supplied from the ink container 10B to the recording head 20. In this state, the pressing member 70 has displaced the connective tube 60A, with the presence of a pressing film 67 formed of rubber or the like, between the pressing member 70 and the connective tube 60A. Thus, the pressing film 67 has been substantially deformed by the displacement of the pressing member 70.

According to this embodiment, the frictional resistance to which the connective tube 60A is subjected is limited to the friction between the connective tube 60A and connective tube sealing member 63. Therefore, it is possible to reduce the amount of force to be applied to press the pressing member 70. Further, the portion of the shell of the ink container 10B, which houses the connective tube 60A, is completely sealed across the top end. Therefore, it is possible to substantially reduce the possibility that ink will seep out through the interface between the connective tube 60A and sealing member.

Miscellaneous Embodiments

Basically, all the ink containers in the preceding embodiments used the structural arrangement in which ink was directly stored in the ink storage chamber of the ink container, and was directly supplied therefrom, instead of storing ink in an ink absorbing member or the like. Further, in order to maintain a proper amount of negative pressure in the recording head, not only were they provided with a negative pressure generating means made up of a movable member (sheet, pressure plate) and a spring for keeping the movable member pressed, but also, they were structured so that the ink supplying system remained hermetically sealed.

This structural arrangement is higher in volumetric efficiency than a structural arrangement, in accordance with the prior art, for generating negative pressure, that is, the structural arrangement which generates negative pressure with the use of an absorbent member. This structural arrangement also affords more latitude in ink selection. However, the preceding embodiments are not intended to limit the present invention, which primarily concerns the structural arrangement for connecting an ink container to a recording head. That is, the primary concern of the present invention is the structural arrangement which connects the interior of the ink container to the recording head by guiding the connective tube into the recording head, and does not concern the internal structure of an ink container. Therefore, the present invention is compatible with an ink container which utilizes the capillary force of an absorbing member to generate the negative force.

Further, in the preceding embodiments, the ink containers were structured so that the ink in the ink container can be used up by introducing the atmospheric air into the ink storage chamber 12. However, these embodiments are not intended to limit the present invention in terms of its primary concern, that is, the structural arrangement for connecting an ink container to a recording head. In other words, the present invention is also compatible with an ink container which does not have the valve chamber 30 and is structured so that the negative pressure is generated by the spring 15, pressure plate 14, and sheet 11.

Further, in the embodiments described above, the recording method employed by each of the ink jet recording apparatuses was described as a recording method of the serial type. However, the application of the present invention is not limited to an ink jet recording of the serial type. That is, the present invention and its embodiments are also applicable to an ink jet recording apparatus which is not of the serial type, that is, a recording apparatus of the line scan type. Further, an ink jet recording apparatus may be provided with multiple liquid supplying systems according to the number of inks different in tone (color, density, etc.), which is needless to say.

Further, in the preceding embodiments, the present invention was applied to the ink container for supplying the recording head with ink. However, the present invention is also applicable to an ink supplying portion for supplying a pen, as a recording portion, with ink.

Further, the present invention is applicable to the various recording apparatuses other than those mentioned above. For example, it is applicable to apparatuses for supplying various liquids, such as drinking water, liquid seasoning, and apparatuses used in the medical field to supply medicines. In other words, the present invention is widely applicable in various fields.

Example of Ink Jet Recording Apparatus Structure

Figure 8:
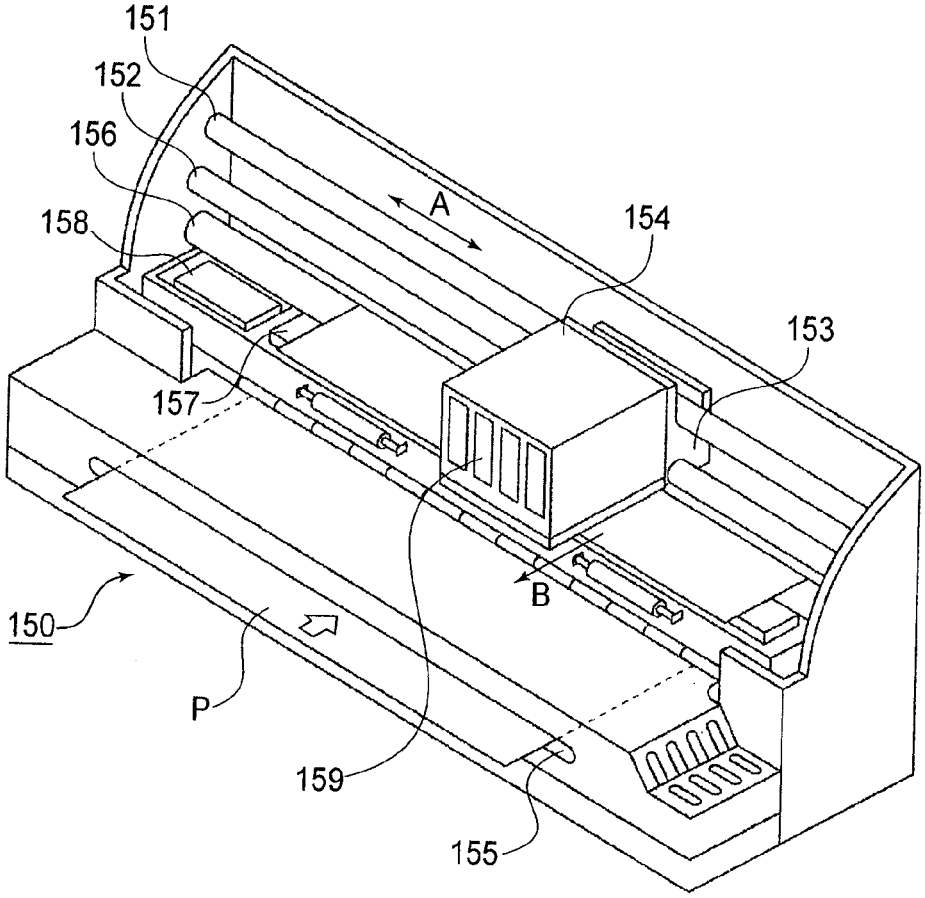
FIG. 8 is a perspective view of the recording apparatus in accordance with the present invention.

FIG. 8 is a drawing for describing an example of the structure of a typical ink jet recording apparatus to which the present invention is applicable.

This example of recording apparatus 150 is an ink jet recording apparatus which employs the serial scan recording method. A carriage 153 is supported by a pair of guide shafts 151 and 152 so that it can be movable in the primary scan direction, which is indicated by an arrow mark A. The carriage 153 is reciprocally moved in the primary scan direction by a carriage motor, and a driving force transmitting mechanism made up of a belt or the like for transmitting the driving force of the motor. On the carriage 153, the recording head and/or ink container, which made one of the preceding embodiments possible, is mounted. A recording paper P as recording medium is inserted into the recording apparatus through a recording medium insertion slot 155 with which the front portion of the apparatus is provided. Then, it is further conveyed so that it is reversed in the direction in which it advances. Then, it is further conveyed by a conveyance roller 156 in the secondary scan direction indicated by an arrow mark B. The recording apparatus 150 records an image, in sequential sections, on the recording paper P by alternately repeating the process of causing its recording head to jet ink toward the recording area of the recording paper P on a platen 157 while moving the recording head in the primary scan direction, and the process of conveying the recording paper P in the secondary scan direction by a distance equal to the width of each of the sequential sections of an intended image, in terms of the secondary scan direction, which is recorded as the recording head is moved in the primary scan direction.

The recording head may be such a recording head that uses the thermal energy generated by an electro-thermal transducer, as the energy for jetting ink. In the case of such a recording head, ink is made to boil by the heat generated by an electro-thermal transducer, and the energy, which is generated by the bubbles as the bubbles grow, can be used to jet ink through the ink jetting orifices. The method for causing a recording head to jet ink does not need to be limited to the abovementioned method, that is, the method which uses an electro-thermal transducer. For example, it may be an ink jetting method which uses a piezoelectric element.

Referring to FIG. 8, at the left end of the moving range of the carriage 153, a recovery system unit 158 (means for recovering recording head performance) is located. The recovery system unit 158 is positioned so that it opposes the surface of the recording head, which has the opening of each ink jetting orifice of the recording head. The recovery system unit 158 is provided with a cap enabled to cap the ink jetting orifices, a suction pump enabled to generate negative pressure in the cap, etc. The recovery process, which is for maintaining the ink jetting performance of the recording head at a desirable level, is a process for suctioning out the ink in the recording head by generating negative pressure in the cap while the ink jetting orifices remain capped with the cap. Further, such a recovery process (which sometimes is referred to as preliminary jetting process) that is for maintaining the ink jetting performance of the recording head at a desirable level by jetting ink toward the interior of the cap, instead of jetting ink toward recording medium as ink is jetted in an image forming operation, may be carried out.

INDUSTRIAL APPLICABILITY

According to the present invention, it is possible to reliably prevent the ink outlet of an ink container from leaking ink, even though it is the ink container that is provided with a connective tube. Further, it is possible to prevent the ink container from being damaged by a fall or the like accident, because the connective tube does not protrude from the shell of the ink container (it remains stored in shell) while the ink container is distributed, even though it is the ink container that is provided with a connective tube. Further, it is possible to make an ink container compact. Further, the ink outlet is a part of the bottom wall of the ink container, and yet, the ink container can be mounted from the front side of the recording apparatus, making it possible to place certain things on the top surface of the recording apparatus. Further, the structural arrangement in accordance with the present invention effects a user in such a way that the user instinctively makes the ink container to follow the bottom surface of the ink container mounting compartment, ensuring thereby that the ink container is more precisely positioned in terms of its height direction.

Further, even if the connective tube is slightly misaligned from the ink inlet of the recording head while the connective tube is guided into the ink container by the movement of the pressing member, the axial line of the connective tube is made to coincide with the axial line of the ink inlet of the recording head by the resiliency of the elastic member; the misalignment is corrected. Further, it is possible to keep the liquid chamber of the ink container hermetically sealed, without employing complicated components and complicated structural arrangement, in order to prevent the decline in ink supply performance, which is attributable to the evaporation of ink solvent and/or adhesion of solidified ink, when the ink container is not in connection with the recording head. Further, the ink container in accordance with the present invention can be extended in service life by reducing the amount of load to which the connective tube is subjected, by connecting the ink container to the recording head after detecting the ink container position.

CLAIM OF PRIORITY

This application claims priority from Japanese Patent Application No. 2004-371058 filed on Dec. 22, 2004, the entire contents of which are hereby incorporated by reference herein.

The invention claimed is:

1. An ink container containing ink to be supplied to an ink jet recording head which is provided in an ink jet recording apparatus and which is provided with an ink introduction opening, the ink container comprising:

an ink containing portion for directly containing the ink;

a connective tube having an ink flow path, wherein the connective tube is movable between a first position in which the connective tube is projected through an opening in the ink container and a second position in which the connective tube is inside the ink container and not projected through the opening, wherein in the first position the connective tube is positioned for fluid communication with the ink introduction opening of the ink jet recording head;

a spring member urging the connective tube in a direction from the first position toward the second position;

a pressable portion, provided on the connective tube, to be pressed by a pressing member provided in the ink jet recording apparatus, wherein the connective tube is movable from the second position to the first position against an urging force of the spring member by pressing of the pressable portion by the pressing member; and an insertion opening for permitting entry of the pressing member into the inside of the ink container.

2. An ink container according to claim 1, further comprising a sealing member for preventing the ink in the ink containing portion from leaking out through the opening and the insertion opening of the ink container.

3. An ink container according to claim 1, wherein the pressable portion of the connective tube faces the insertion opening and is capable of being directly pushed by the pressing member.

4. An ink container according to claim 1, further comprising a sheet member of flexible material provided in the insertion opening, wherein the connective tube is capable of being pushed by the pressing member through the sheet member.

5. An ink container according to claim 1, wherein the pressing member of the ink jet recording apparatus is movable with a mounting operation of the ink container to the ink jet recording apparatus, and an outer casing of the ink container is provided with a guide for moving the pressing member.

6. An ink container according to claim 1, wherein the opening of the ink container is provided in a side thereof which is a bottom side in use.

7. An ink container according to claim 1, wherein the ink containing portion of the ink container includes a flexible sheet member and an elastic member and an ambient air introduction mechanism for introducing ambient air into the ink containing portion from an outside of the ink container in accordance with a state of the ink containing portion, wherein the ink containing portion directly contains the ink.

8. An ink container according to claim 7, wherein the ink containing portion contains, when the ink container is not mounted to the ink jet recording apparatus, the ink with a pressure which is equivalent to or higher than a pressure when the ink container is mounted and is operated.

9. An ink jet recording apparatus comprising:

an ink jet recording head which is provided with an ink introduction section;

an ink container mounting portion for mounting an ink container; and a pressing member in the vicinity of the ink container mounting portion, wherein the ink container includes:

an ink containing portion for directly containing ink to be supplied to the ink jet recording head provided in the ink jet recording apparatus;

a connective tube having an ink flow path, wherein the connective tube is movable between a first position in which the connective tube is projected through an opening in the ink container and a second position in which the connective tube is inside the ink container and not projected through the opening, wherein in the first position the connective tube is positioned for fluid communication with the ink introduction section of the ink jet recording head;

a spring member urging the connective tube in a direction from the first position toward the second position;

a pressable portion, provided on the connective tube, to be pressed by the pressing member, wherein the connective tube is movable from the second position to the first position against an urging force of the spring member by pressing of the pressable portion by the pressing member; and an insertion opening for permitting entry of the pressing member into the inside of the ink container.

10. An apparatus according to claim 9, wherein the pressing member is independently operated after mounting of the ink container to the mounting portion to push the connective tube of the ink container.

11. An apparatus according to claim 9, wherein the pressing member is provided with a guide contact member engageable with a guide to enable an operation along the guide provided on an outer casing of the ink container.

* * * * *